United States Patent [19]

Smitka et al.

[11] 4,334,857

[45] Jun. 15, 1982

[54] CRUCIBLE FURNACE

[75] Inventors: Artur Smitka, Schwerte; Josef Rabe, Dortmund, both of Fed. Rep. of Germany

[73] Assignee: BBC Brown, Boveri & Company, Limited, Baden, Switzerland

[21] Appl. No.: 149,751

[22] Filed: May 14, 1980

[30] Foreign Application Priority Data

May 16, 1979 [DE] Fed. Rep. of Germany ..... 2919705

[51] Int. Cl.[3] ..... F27D 7/00; F27B 14/00

[52] U.S. Cl. ..... 432/3; 13/35; 373/76

[58] Field of Search ..... 432/3, 156, 157, 158; 13/30, 35

[56] References Cited

U.S. PATENT DOCUMENTS

| | | | |
|---|---|---|---|
| 559,868 | 5/1896 | Scoville | 432/156 |
| 1,013,377 | 1/1912 | De Bats | 432/156 |
| 1,086,835 | 2/1914 | Melas | 432/156 |
| 1,171,500 | 2/1916 | Brown | 432/156 |

*Primary Examiner*—John J. Camby

*Attorney, Agent, or Firm*—Oblon, Fisher, Spivak, McClelland & Maier

[57] ABSTRACT

A crucible furnace includes an ejector for removing the crucible from the furnace. The ejector consists of an ejector apparatus located below the floor of the furnace. A pressure transfer body in the shape of an inverted truncated cone is normally inserted in a truncated cone-shape opening in the furnace floor. The ejector acts upon the pressure transfer body to lift the body, as well as the crucible resting upon the body, out of the furnace. A hydraulic cylinder activates the ejector device.

7 Claims, 1 Drawing Figure

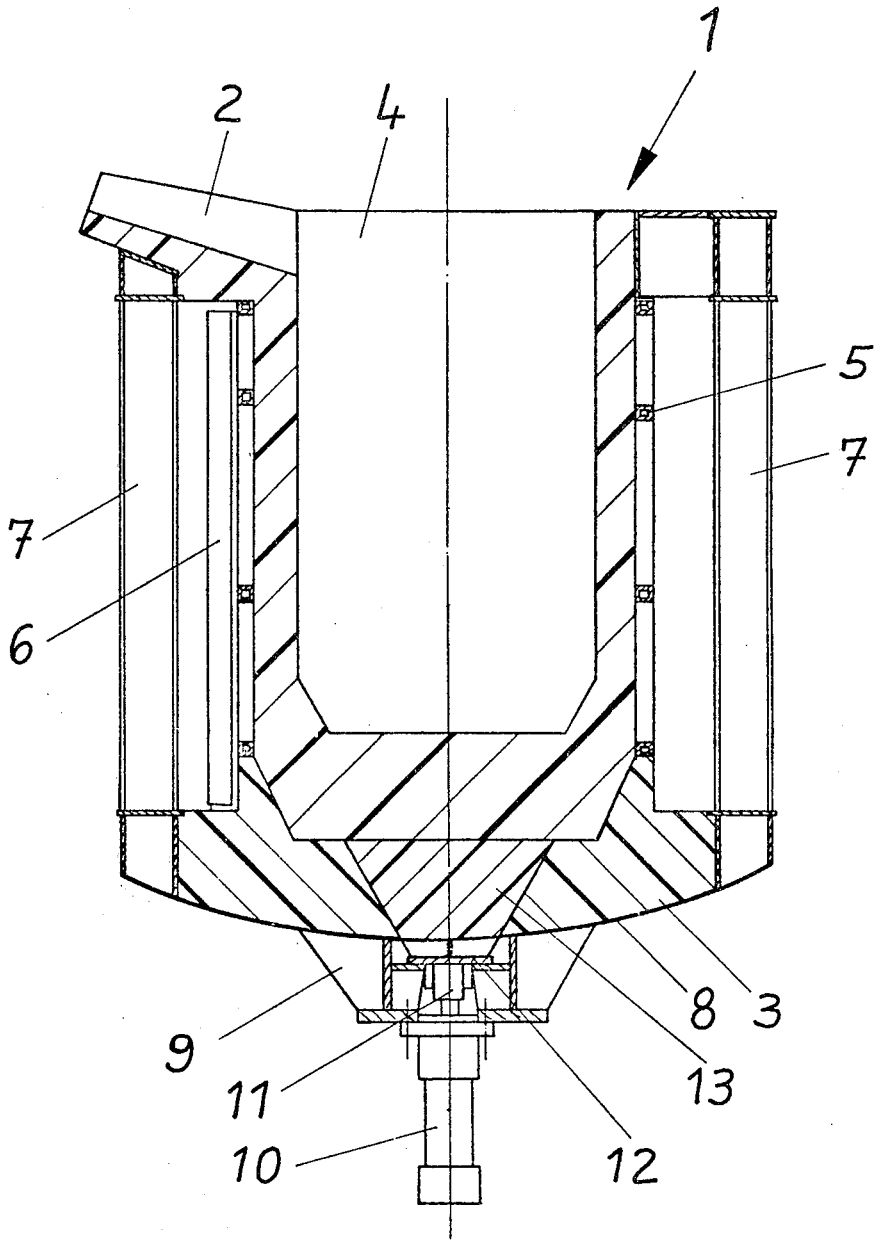
1
2
4
5
7
7
6
9
11
10
12
13
8
3

CRUCIBLE FURNACE

BACKGROUND OF THE INVENTION

1. Field of the Invention

The present invention relates to a crucible furnace with a furnace body, a fireproof floor and a changeable crucible.

2. Description of the Prior Art

The crucibles of crucible ovens are composed of a fireproof material such as quartzite or magnezite. They are preferably produced by pulverization. These crucibles get worn out in use. Therefore, they must be replaced regularly at intervals of about 3 to 6 weeks. In addition to this, the crucibles are customarily broken up with a pneumatic hammer in the furnace and the broken pieces are cleaned out. This work is attended by a considerable amount of troublesome noise and dust and is very time consuming.

The avoidance of a long interruption of furnace usage is known from the DE-AS No. 10 50 025, which discloses an induction crucible furnace in which the crucible, induction coil and magnet yoke are combined into an independent replaceable unit with corresponding rigidity. During repair on one of the combination parts, the replacement part is lifted out of the furnace body with a crane so that the repairs can take place in a more appropriate place. In the meantime, furnace use can continue with a replacement part.

From the DEOS No. 24 00 519 a procedure is known for the removal of a crucible from a crucible furnace, as well as a crucible furnace for the execution of the procedure. This known crucible furnace possesses a removeable fireproof floor. For the removal of the crucible the furnace is laid on the side and the floor is dismantled. Finally, the furnace part which contains the crucible is again placed upright and the crucible is pushed out downardly. Moreover, a pour spout which is formed on the crucible must be specially removed. To simplify the pushing out of the crucible, it has been proposed that the crucible and the oven frame be formed slightly conical.

Such removable floors are, however, heavy and cumbersome. Besides that, the construction for the fastening of the floor on the furnace is relatively complicated as is shown in the DEAS No. 20 58 093 in which a converter with a removeable base is described.

SUMMARY OF THE INVENTION

The object of the present invention is the provision of a crucible furnace whose worn out crucible can be simply and quickly removed.

This object can be achieved by an ejection device provided on the bottom of the furnace which presses directly from the base of the cooled crucible and which lifts it upward out of the furnace body.

The present invention proceeds from the generally known fact that the pulverized crucible mass vitrifies (sinters) during operation of the furnace and consequently forms a solid block of sinter, the actual crucible, in the area where the crucible and molten material touch. During cooling this sintered crucible shrinks more than the rest of the furnace parts so that a crack forms between the crucible and the furnace. This cracking which, until now has been avoided by never allowing the furnace to cool is now used to push the crucible upward out of the oven. Thereby, the costly shattering of the crucible and the cleaning out of the broken pieces from the furnace is eliminated, as well as the necessity for the construction of a removeable floor, removing the pour spout prior to expulsion, and providing a trench into which the used crucible can be pushed out.

Preferably a recess is provided in the fireproof floor and a fireproof pressure transfer body is inserted therein. The result is that the thermal conditions on the floor of the crucible are not adversely altered yet the used crucible is easily upwardly expelled.

The recess and the pressure transfer body are advantageously formed in a truncated cone shape, whereby the cone tip is directed downwards, away from the bottom of the crucible. Therefore, the crucible supports itself on a large surface area on the fireproof floor and over the fireproof floor on the furnace body.

A hydraulic cylinder is preferably provided to generate pressure and can be removeable at the same time.

BRIEF DESCRIPTION OF THE DRAWINGS

Various other objects, features, and attendant advantages of the present invention will be more fully appreciated as the same becomes better understood from the following detailed description when considered in connection with the accompanying drawings in which like reference characters designate like or corresponding parts throughout the several views, and wherein:

The FIGURE is a cross section of the furnace of the invention.

DETAILED DESCRIPTION OF THE PREFERRED EMBODIMENTS

Shown in the FIGURE are a crucible furnace 1, with a crucible 4, having a formed pour spout 2. The base of the crucible 4 stands on a fireproof, stationary floor 3 which is attached to the furnace body which consists of a base plate 8 and the furnace body member 7. A water cooled induction coil 5 is spirally wrapped around the crucible 4. This induction coil 5 is indicated by the coil winding visible in the cross-section.

Magnet yokes 6 are regularly spaced and peripherally arranged around the induction coil 5 which insure the magnetic backflow.

In the fireproof floor 3, a truncated cone-shaped recess is formed in which a similarly truncated cone-shaped pressure transfer body (ejector) 13 is inserted. While in the quiescent condition the pressure transfer body (ejector) 13 supports itself on the fireproof floor 3, and therewith on the base plate 8 of the furnace body. On the underside of the base plate 8 is fastened a mounting device 9 on which a hydraulic cylinder is so mounted that its piston 11, lying over a pressure plate 12, can press on the underside of the pressure transfer body (ejector) 13. The hydraulic cylinder 10 can either be immovably mounted or screwed on for the ejection of the crucible 4.

In order to relieve the pressure cylinder 10 of the weight of the crucible 4 during ejection, the furnace 1 can be tipped approximately 90°. The partially ejected crucible 4 can then, according to the stroke length of the hydraulic cylinder 10, be completely pulled out by means of a crane.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A crucible furnace comprising:

a furnace body including side walls having heating means;

a fireproof furnace floor;

a crucible formed of pulverized sinterable fireproof material, said crucible resting on said furnace floor, said crucible also contacting and being supported by said heating means of said side walls of said furnace; and a crucible ejection device acting on the underside of said furnace floor, whereby said crucible is at least partially sintered in use and contracts upon cooling so that said ejection device may lift said crucible out of said furnace.

2. The crucible furnace of claim 1 wherein a recess is provided in said fireproof floor and a fireproof pressure transfer body movable with said ejection device is inserted therein.

3. The crucible furnace of claim 2, wherein said recess and said pressure transfer body are formed in the shape of a truncated cone.

4. The crucible furnace of claims 1, 2, or 3, wherein the ejection device is actuated by a hydraulic cylinder.

5. The crucible furnace of claim 4 wherein said hydraulic cylinder is removeable.

6. A method of removing a pulverized, sinterable, fireproof crucible from a crucible furnace having side wall means wherein said side wall means contact and support said crucible, said method comprising the steps of:

heating said crucible whereby said crucible becomes at least partially sintered;

cooling said furnace and crucible whereby said at least partially sintered crucible contracts and separates from said side wall means; and utilizing a crucible ejection device associated with the floor of said furnace to lift said crucible out of said furnace.

7. The method of claim 6 including the step of rotating said furnace by 90° about a horizontal axis prior to said step of lifting said crucible out of said furnace.

* * * * *